US011756713B2

(12) United States Patent
Yoshizaki et al.

(10) Patent No.: US 11,756,713 B2
(45) Date of Patent: Sep. 12, 2023

(54) GRAIN-ORIENTED MAGNETIC STEEL SHEETS HAVING CHROMIUM-FREE INSULATING TENSION COATING, AND METHODS FOR PRODUCING SUCH STEEL SHEETS

(71) Applicant: JFE Steel Corporation, Tokyo (JP)

(72) Inventors: Souichiro Yoshizaki, Tokyo (JP); Makoto Watanabe, Tokyo (JP); Ryuichi Suehiro, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 1164 days.

(21) Appl. No.: 16/324,211

(22) PCT Filed: Sep. 8, 2017

(86) PCT No.: PCT/JP2017/032406
§ 371 (c)(1),
(2) Date: Feb. 8, 2019

(87) PCT Pub. No.: WO2018/051902
PCT Pub. Date: Mar. 22, 2018

(65) Prior Publication Data

US 2021/0287834 A1 Sep. 16, 2021

(30) Foreign Application Priority Data

Sep. 13, 2016 (JP) ..... 2016-178258

(51) Int. Cl.

| | |
|---|---|
| ***H01F 1/18*** | (2006.01) |
| ***C21D 8/12*** | (2006.01) |
| ***C22C 38/00*** | (2006.01) |
| ***C23C 22/12*** | (2006.01) |
| ***C23C 22/18*** | (2006.01) |
| ***C23C 22/20*** | (2006.01) |
| ***C23C 22/22*** | (2006.01) |
| ***C23C 22/74*** | (2006.01) |
| ***H01F 1/147*** | (2006.01) |

(52) U.S. Cl.
CPC ..... *H01F 1/18* (2013.01); *C21D 8/1283* (2013.01); *C21D 8/1288* (2013.01); *C22C 38/00* (2013.01); *C23C 22/12* (2013.01); *C23C 22/188* (2013.01); *C23C 22/20* (2013.01); *C23C 22/22* (2013.01); *C23C 22/74* (2013.01); *H01F 1/147* (2013.01); *C21D 2201/05* (2013.01)

(58) Field of Classification Search
CPC ..... C21D 8/1283; C21D 8/1288; C23C 22/74
See application file for complete search history.

(56) References Cited

U.S. PATENT DOCUMENTS

| | | | |
|---|---|---|---|
| 2009/0233114 | A1 | 9/2009 | Takeda et al. |
| 2011/0236581 | A1 | 9/2011 | Muraki et al. |
| 2013/0251984 | A1 | 9/2013 | Schepers et al. |
| 2017/0137633 | A1 | 5/2017 | Terashima et al. |

FOREIGN PATENT DOCUMENTS

| | | | | | |
|---|---|---|---|---|---|
| CN | 103221556 | A | | 7/2013 | |
| CN | 105733430 | A | | 7/2016 | |
| EP | 2902509 | A1 | | 8/2015 | |
| EP | 3101157 | A1 | | 12/2016 | |
| JP | 54143737 | A | | 11/1979 | |
| JP | 5652117 | A | | 5/1981 | |
| JP | 5675579 | A | | 6/1981 | |
| JP | 06287764 | A | | 10/1994 | |
| JP | 2000169972 | A | | 6/2000 | |
| JP | 2000169973 | A | | 6/2000 | |
| JP | 2000178760 | A | | 6/2000 | |
| JP | 2005200705 | A | | 7/2005 | |
| JP | 2007023329 | A | | 2/2007 | |
| JP | 2008050676 | A | | 3/2008 | |
| JP | 2008050676 | A | * | 3/2008 | ..... C23C 22/08 |
| JP | 2009013467 | A | * | 1/2009 | |
| JP | 2009013467 | A | | 1/2009 | |
| JP | 2009041074 | A | | 2/2009 | |

(Continued)

OTHER PUBLICATIONS

Ando F, JP-2010013692-A machine translation, Jan. 21, 2010 (Year: 2010).*

(Continued)

*Primary Examiner* — Nicholas A Wang
*Assistant Examiner* — Maxwell Xavier Duffy
(74) *Attorney, Agent, or Firm* — RATNERPRESTIA

(57) ABSTRACT

A grain-oriented magnetic steel sheet with chromium-free insulating tension coating includes a grain-oriented magnetic steel sheet and an insulating tension coating containing a phosphate salt and silica on a surface of the grain-oriented magnetic steel sheet, the coating further including a crystalline compound represented by the general formula (1): $M^{II}{}_3M^{III}{}_4(X^VO_4)_6$ . . . (1). A method for producing a grain-oriented magnetic steel sheet with chromium-free insulating tension coating includes applying an insulating tension coating liquid to a surface of a finish annealed grain-oriented magnetic steel sheet, the coating liquid including colloidal silica, a phosphate salt and a metal element M-containing compound in a specific ratio, and heat treating the steel sheet at least one time at a temperature of not less than 900° C. in an atmosphere including a non-oxidizing gas and having a dew point of not more than 0° C.

23 Claims, No Drawings

(56) References Cited

FOREIGN PATENT DOCUMENTS

| | | | | |
|---|---|---|---|---|
| JP | 4321120 | B2 | | 8/2009 |
| JP | 2010013692 | A | * | 1/2010 |
| JP | 2010059513 | A | | 3/2010 |
| JP | 4682590 | B2 | | 5/2011 |
| JP | 2012158800 | A | | 8/2012 |
| JP | 5328375 | B2 | | 10/2013 |
| WO | 2007136115 | A1 | | 11/2007 |
| WO | 2015115036 | A1 | | 8/2015 |
| WO | 2015162837 | A1 | | 10/2015 |
| WO | 2016091059 | A1 | | 6/2016 |

OTHER PUBLICATIONS

Takamiya T, JP 2009013467 A description machine translation, Jan. 22, 2009 (Year: 2009).*

Ralph Poor, Steve Ruoff, Thomas Philips, Furnace Atmospheres for Heat Treating, 2014, ASM International, ASM Handbook vol. 4B, pp. 542-567 (Year: 2014).*

Hiraya T, JP-2008050676-A machine translation, Mar. 6, 2008 (Year: 2008).*

Canadian Office Action for Canadian Application No. 3,032,648, dated Feb. 28. 2020, 3 pages.

Chinese Office Action with Search Report for Chinese Application No. 201780048841.1, dated Jul. 20, 2020, 10 pages.

Extended European Search Report far European Application No. 17 850 804.0, dated May 7, 2019, 8 pages.

European Communication pursuant to Article 94(3) for European Application No. 17 850 804.0, dated May 25, 2020, 4 pages.

Korean Office Action for Korean Application No. 10-2019-7003769, dated Jun. 1, 2020, with Concise Statement of Relevance of Office Action, 6 pages.

International Search Report and Written Opinion for International Application No. PCT/JP2017/032406, dated Oct. 10, 2017—5 pages.

* cited by examiner

GRAIN-ORIENTED MAGNETIC STEEL SHEETS HAVING CHROMIUM-FREE INSULATING TENSION COATING, AND METHODS FOR PRODUCING SUCH STEEL SHEETS

CROSS REFERENCE TO RELATED APPLICATIONS

This is the U.S. National Phase application of PCT/JP2017/032406, filed Sep. 8, 2017, which claims priority to Japanese Patent Application No. 2016-178258, filed Sep. 13, 2016, the disclosures of these applications being incorporated herein by reference in their entireties for all purposes.

FIELD OF THE INVENTION

Grain-oriented magnetic steel sheets are deteriorated in moisture absorption resistance and coating tension when chromium is not used in their insulating tension coatings. The present invention relates to grain-oriented magnetic steel sheets with chromium-free insulating tension coating that overcome this problem and perform well in such coating characteristics.

BACKGROUND OF THE INVENTION

Grain-oriented magnetic steel sheets usually have a coating on the surface which offers properties such as insulation properties, workability and rust resistance. An example of such coatings is one composed of an undercoating based on forsterite formed during finish annealing (annealing for secondary recrystallization) and a phosphate-based insulating tension coating formed on the top. These coatings are formed at high temperatures and have a low thermal expansion coefficient. When the temperature fell to room temperature, the coating comes to have a large difference in thermal expansion coefficient from the steel sheet and generates a tension to the steel sheet, thus effectively reducing the iron loss. It is therefore desirable that the coating be capable of imparting as high a tension as possible to the steel sheet.

To satisfy such characteristics, numerous coatings have been presented.

For example, Patent Literature 1 proposes a coating formed from a treatment liquid containing magnesium phosphate, colloidal silica and chromic anhydride. Further, Patent Literature 2 proposes a coating formed from a coating liquid containing aluminum phosphate, colloidal silica and chromic anhydride.

The recent growing interest in environmental preservation has led to a strong demand for the development of insulating tension coatings containing no harmful chromium. The coatings described in Patent Literatures 1 and 2 contain chromium and hence have a significant adverse effect on the environment. Chromium-free coatings are thus demanded.

However, coatings cannot be freed from chromium because the elimination of chromium (adding no chromium) results in a marked deterioration in moisture absorption resistance and an insufficient tension.

To solve the above problem, Patent Literature 3 proposes a method for forming a coating using a treatment liquid containing colloidal silica, aluminum phosphate, boric acid and sulfate. However, coatings formed by this method alone compare unfavorably to chromium-containing coatings in terms of iron loss and moisture absorption resistance.

Regarding other chromium-free coating methods, for example, Patent Literature 4 discloses a method in which a boron compound is added in place of a chromium compound, Patent Literature 5 discloses a method in which an oxide colloid is added, and Patent Literature 6 discloses a method in which a metal organic acid salt is added.

However, these techniques are not perfect solutions because none of them are capable of attaining moisture absorption resistance and reducing the iron loss by tensioning to the same levels as when chromium is added to the coatings.

Patent Literature 7 discloses a technique which focuses attention on a forsterite-based undercoating rather than on an insulating tension coating. Specifically, a technique is disclosed which imparts moisture absorption resistance and coating tension to a chromium-free insulating tension coating by forming a forsterite-based undercoating while controlling the coating weight of oxygen in the forsterite-based undercoating. By this technique, an insulating tension coating having excellent moisture absorption resistance and coating tension can be realized without the use of chromium.

However, in recent years, as disclosed in Patent Literature 8, an annealing separator containing a sulfate salt is applied to a steel sheet before finish annealing to enhance the magnetic properties of the steel sheet. When such a technique is adopted, it is difficult to form an undercoating suited as a base for the formation of a chromium-free insulating tension coating.

PATENT LITERATURE

PTL 1: Japanese Examined Patent Application Publication No. 56-52117

PTL 2: Japanese Examined Patent Application Publication No. 53-28375

PTL 3: Japanese Examined Patent Application Publication No. 57-9631

PTL 4: Japanese Unexamined Patent Application Publication No. 2000-169973

PTL 5: Japanese Unexamined Patent Application Publication No. 2000-169972

PTL 6: Japanese Unexamined Patent Application Publication No. 2000-178760

PTL 7: Japanese Patent No. 4682590

PTL 8: Japanese Patent No. 4321120

SUMMARY OF THE INVENTION

Aspects of the present invention have been made in view of the circumstances discussed above. It is therefore an object according to aspects of the invention to provide grain-oriented magnetic steel sheets that have a chromium-free insulating tension coating with excellent moisture absorption resistance and coating tension, and methods for producing such steel sheets.

The present inventors extensively studied approaches to improving the moisture absorption resistance and coating tension of chromium-free insulating tension coatings. As a result, the present inventors have obtained a new finding that both of these characteristics are improved by incorporating a crystalline compound represented by the general formula (1) below into an insulating tension coating.

$$M^{II}_3M^{III}_4(X^VO_4)_6 \quad (1)$$

In the general formula (1), $M^{II}$ and $M^{III}$ are each independently one, or two or more selected from Sc, Ti, V, Mn, Fe, Co, Ni, Cu and Mg, and $X^V$ is one, or two or more selected from P, V and Mo.

The number of $M^{II}$ in the general formula (1) is 3; when, for example, $M^{II}$ indicates two or more kinds of the above atoms, the total number of such atoms is 3. Similarly, the number of $M^{III}$ in the general formula (1) is 4; when $M^{III}$ indicates two or more kinds of the above atoms, the total number of such atoms is 4. The number of $(X^{V}O_4)$ in the general formula (1) is 6; when $(X^{V}O_4)$ indicates two or more kinds of groups of atoms, the total number of such groups of atoms is 6.

Hereinbelow, the experiments which have led to the above finding will be described.

Grain-oriented magnetic steel sheets produced by a known method with a sheet thickness of 0.23 mm which contained 3.25 mass % Si and had been subjected to finish annealing (annealing for secondary recrystallization) were pickled with a phosphoric acid solution. An insulating tension coating liquid which contained 20 parts by mass in terms of solid of colloidal silica, 40 parts by mass (in terms of solid) of magnesium primary phosphate and 5 parts by mass (in terms of FeO) of iron (III) hydroxide was applied so that the total dry coating mass on both sides would be 10 g/m$^2$. The steel sheets were fed to a drying furnace and dried (300° C., 1 minute). The resultant steel sheets were treated by any of the following treatments.

A: The steel sheet was heat treated in a $N_2$ atmosphere having a dew point of −20° C., at 800° C. for 2 minutes.

B: The steel sheet was heat treated in a $N_2$ atmosphere having a dew point of −20° C., at 800° C. for 2 minutes, and was thereafter subjected to the second heat treatment in which the steel sheet was heat treated in a $N_2$ atmosphere having a dew point of −20° C., at 850° C. for 30 seconds.

C: The steel sheet was heat treated in a $N_2$ atmosphere having a dew point of −20° C., at 800° C. for 2 minutes, and was thereafter subjected to the second heat treatment in which the steel sheet was heat treated in a $N_2$ atmosphere having a dew point of −20° C., at 900° C. for 30 seconds.

D: The steel sheet was heat treated in a $N_2$ atmosphere having a dew point of −20° C., at 800° C. for 2 minutes, and was thereafter subjected to the second heat treatment in which the steel sheet was heat treated in a $N_2$ atmosphere having a dew point of −20° C., at 950° C. for 30 seconds.

E: The steel sheet was heat treated in a $N_2$ atmosphere having a dew point of −20° C., at 800° C. for 2 minutes, and was thereafter subjected to the second heat treatment in which the steel sheet was heat treated in a $N_2$ atmosphere having a dew point of −20° C., at 1000° C. for 30 seconds.

F: The steel sheet was heat treated in a $N_2$ atmosphere having a dew point of −20° C., at 800° C. for 2 minutes, and was thereafter subjected to the second heat treatment in which the steel sheet was heat treated in a $N_2$ atmosphere having a dew point of −20° C., at 1050° C. for 30 seconds.

G: The steel sheet was heat treated in a $N_2$ atmosphere having a dew point of 20° C., at 800° C. for 2 minutes, and was thereafter subjected to the second heat treatment in which the steel sheet was heat treated in a $N_2$ atmosphere having a dew point of −20° C., at 900° C. for 30 seconds.

H: The steel sheet was heat treated in a $N_2$ atmosphere having a dew point of −20° C., at 800° C. for 2 minutes, and was thereafter subjected to the second heat treatment in which the steel sheet was heat treated in a $N_2$ atmosphere having a dew point of −10° C., at 900° C. for 30 seconds.

I: The steel sheet was heat treated in a $N_2$ atmosphere having a dew point of −20° C., at 800° C. for 2 minutes, and was thereafter subjected to the second heat treatment in which the steel sheet was heat treated in a $N_2$ atmosphere having a dew point of 0° C., at 900° C. for 30 seconds.

J: The steel sheet was heat treated in a $N_2$ atmosphere having a dew point of −20° C., at 800° C. for 2 minutes, and was thereafter subjected to the second heat treatment in which the steel sheet was heat treated in a $N_2$ atmosphere having a dew point of 20° C., at 900° C. for 30 seconds.

K: The steel sheet was heat treated in a $N_2$ atmosphere having a dew point of −20° C., at 800° C. for 2 minutes, and was thereafter subjected to the second heat treatment in which the steel sheet was heat treated in an oxygen-containing $N_2$ atmosphere having a dew point of −20° C., at 900° C. for 30 seconds.

The oxygen concentration (volume concentration) in the above $N_2$ atmosphere is not more than 1000 ppm, and the oxygen concentration in the oxygen-containing $N_2$ atmosphere is 2000 ppm.

The grain-oriented magnetic steel sheets with insulating tension coating obtained as described above were tested by the following methods to evaluate iron loss, coating tension and moisture absorption resistance.

The iron loss was measured in accordance with JIS C 2550 with respect to test pieces 30 mm in width×280 mm in length prepared by the grain-oriented magnetic steel sheet with insulating tension coating.

The coating tension σ was determined in the following manner using the equation described below. A test piece 30 mm in width×280 mm in length prepared by the grain-oriented magnetic steel sheet with insulating tension coating was cleaned of the insulating tension coating on one side with use of agents such as alkali and acid. A 30 mm end portion of the test piece was fixed, and the warpage over the measurement length (250 mm) of the test piece was measured. The Young's modulus of the steel sheet was 121520 MPa.

$$\sigma\ (\text{MPa}) = \text{Young's modulus (MPa) of steel sheet} \times \text{Sheet thickness (mm)} \times \text{Warpage (mm)} / (\text{Measurement length (mm)})^2$$

The moisture absorption resistance is a measure of the resistance of an insulating tension coating to dissolution in water. Three 50 mm×50 mm test pieces prepared by the grain-oriented magnetic steel sheet with insulating tension coating were soaked in boiling distilled water at 100° C. for 5 minutes to cause phosphorus to leach from the surface of the insulating tension coating. The solubility was evaluated based on the amount of leaching [μg/150 cm$^2$]. The moisture absorption resistance was evaluated as good when the amount of leaching was not more than 150 [μg/150 cm$^2$]. In accordance with aspects of the present invention, P (phosphorus) which leached was quantitatively analyzed by ICP emission spectroscopy. However, the P leaching quantifying method is not limited thereto.

The results obtained are described in Table 1.

TABLE 1

| No. | Heat treatment | Coating tension (MPa) | Amount of P leaching (μg/150 cm$^2$) | Iron loss W17/50 (W/kg) | Product identified by X-ray diffractometry | Remarks |
|---|---|---|---|---|---|---|
| A | 800° C. ($N_2$, Dew point −20° C.) × 2 min | 7.1 | 126 | 0.763 | None | Comp. Ex. |
| B | 800° C. ($N_2$, Dew point −20° C.) × 2 min<br>850° C. ($N_2$, Dew point −20° C.) × 30 s | 7.3 | 100 | 0.759 | None | Comp. Ex. |
| C | 800° C. ($N_2$, Dew point −20° C.) × 2 min<br>900° C. ($N_2$, Dew point −20° C.) × 30 s | 8.2 | 56 | 0.751 | $Fe_7(PO_4)_6$ | Inv. Ex. |
| D | 800° C. ($N_2$, Dew point −20° C.) × 2 min<br>950° C. ($N_2$, Dew point −20° C.) × 30 s | 8.6 | 48 | 0.749 | $Fe_7(PO_4)_6$ | Inv. Ex. |
| E | 800° C. ($N_2$, Dew point −20° C.) × 2 min<br>1000° C. ($N_2$, Dew point −20° C.) × 30 s | 9.3 | 30 | 0.740 | $Fe_7(PO_4)_6$ | Inv. Ex. |
| F | 800° C. ($N_2$, Dew point −20° C.) × 2 min<br>1050° C. ($N_2$, Dew point −20° C.) × 30 s | 9.4 | 28 | 0.738 | $Fe_7(PO_4)_6$ | Inv. Ex. |
| G | 800° C. ($N_2$, Dew point +20° C.) × 2 min<br>900° C. ($N_2$, Dew point −20° C.) × 30 s | 8.1 | 56 | 0.750 | $Fe_7(PO_4)_6$ | Inv. Ex. |
| H | 800° C. ($N_2$, Dew point −20° C.) × 2 min<br>900° C. ($N_2$, Dew point −10° C.) × 30 s | 8.0 | 68 | 0.755 | $Fe_7(PO_4)_6$ | Inv. Ex. |
| I | 800° C. ($N_2$, Dew point −20° C.) × 2 min<br>900° C. ($N_2$, Dew point 0° C.) × 30 s | 7.8 | 71 | 0.752 | $Fe_7(PO_4)_6$ | Inv. Ex. |
| J | 800° C. ($N_2$, Dew point −20° C.) × 2 min<br>900° C. ($N_2$, Dew point +20° C.) × 30 s | 7.0 | 127 | 0.762 | None | Comp. Ex. |
| K | 800° C. ($N_2$, Dew point −20° C.) × 2 min<br>900° C. (Oxygen-containing $N_2$*), Dew point −20° C.) × 30 s | 6.9 | 123 | 0.766 | None | Comp. Ex. |

*)Oxygen concentration: 2000 ppm

As shown in Table 1, with increasing temperature of the heat treatment, the coating tension was enhanced and the iron loss was reduced and further, the amount of P leaching was smaller, indicating that the moisture absorption resistance was enhanced. Even when the flattening annealing was performed by heat treatment at 800° C. for 2 minutes in an atmosphere having a dew point of 20° C., a reduced amount of P leaching was obtained and an enhanced moisture absorption resistance was attained by performing the second heat treatment for crystallization in a non-oxidizing atmosphere having a dew point of −20° C. (No. G). In contrast, when oxygen was present in the $N_2$ atmosphere (oxygen concentration: 2000 ppm), a small amount of P leaching was not obtained in spite of the heat treatment for crystallization being performed at a temperature of 900° C. or above (No. K).

Further, these steel sheets were analyzed by X-ray diffractometry using a Cu target at 20 kV and 250 mA. With X-ray diffraction pattern analysis software JADE (manufactured by Rigaku Corporation), the background of the diffraction pattern was removed, and the diffraction peaks were analyzed to identify the crystal. The peak search conditions were initial conditions (threshold $\sigma$=3.0). As a result, the steel sheets Nos. C, D, E, F, G, H and I, which exhibited good characteristics, showed a diffraction peak of $Fe_7(PO_4)_6$. From the results discussed above, the enhanced coating characteristics are probably ascribed to the formation of $Fe_7(PO_4)_6$, that is, $M^{II}{}_3M^{III}{}_4(X^VO_4)_6$ in the coating.

Although the mechanism is not fully understood, the present inventors assume that as a result of the formation of crystalline $Fe_7(PO_4)_6$ with a three dimensional structure in the coating, phosphorus present in the coating was strongly fixed, and consequently the moisture absorption resistance was enhanced and a decrease in coating tension was prevented.

A summary of aspects of the present invention is as described below.

[1] A grain-oriented magnetic steel sheet with chromium-free insulating tension coating, comprising a grain-oriented magnetic steel sheet and an insulating tension coating containing a phosphate salt and silica on at least one side of the grain-oriented magnetic steel sheet, the coating further including a crystalline compound represented by the general formula (1) below:

$$M^{II}{}_3M^{III}{}_4(X^VO_4)_6 \quad (1)$$

in the general formula (1), $M^{II}$ and $M^{III}$ are each independently one, or two or more selected from Sc, Ti, V, Mn, Fe, Co, Ni, Cu and Mg, and $X^V$ is one, or two or more selected from P, V and Mo.

[2] The grain-oriented magnetic steel sheet with chromium-free insulating tension coating described in [1], wherein $M^{III}$ is Fe and $X^v$ is P in the general formula (1).

[3] The grain-oriented magnetic steel sheet with chromium-free insulating tension coating described in [1] or [2], wherein the crystalline compound represented by the general formula (1) is $Fe_7(PO_4)_6$.

[4] The grain-oriented magnetic steel sheet with chromium-free insulating tension coating described in any one of [1] to [3], wherein the phosphate salt is one, or two or more selected from phosphate salts of Mg, Fe, Al, Ca, Mn and Zn.

[5] A method for producing a grain-oriented magnetic steel sheet with chromium-free insulating tension coating described in any one of [1] to [4], comprising applying an insulating tension coating liquid to at least one side of a finish annealed grain-oriented magnetic steel sheet, the coating liquid comprising 20 parts by mass in terms of solid of colloidal silica, 10 to 80 parts by mass of a phosphate salt and 5 to 10 parts by mass in terms of oxide of a metal element M-containing compound (the metal element M is one, or two or more selected from Sc, Ti, V, Mn, Fe, Co, Ni, Cu and Mg), and heat treating the steel sheet at least one time at a temperature of not less than 900° C. in an atmosphere including a non-oxidizing gas and having a dew point of not more than 0° C.

[6] A method for producing a grain-oriented magnetic steel sheet with chromium-free insulating tension coating described in any one of [1] to [4], comprising:

applying an insulating tension coating liquid to at least one side of a finish annealed grain-oriented magnetic steel sheet, the coating liquid comprising 20 parts by mass in terms of solid of colloidal silica, 10 to 80 parts by mass of a phosphate salt, and an amount of a crystalline compound represented by the general formula (1), and heat treating the steel sheet at least one time in a non-oxidizing atmosphere.

The grain-oriented magnetic steel sheets according to aspects of the present invention have a chromium-free insulating tension coating which has excellent moisture absorption resistance and coating tension. The production methods according to aspects of the invention can produce such steel sheets.

According to aspects of the present invention, a chromium-free insulating tension coating which has excellent moisture absorption resistance and coating tension can be formed on a grain-oriented magnetic steel sheet without the need of optimizing an undercoating or optimizing an annealing separator applied before finish annealing.

DETAILED DESCRIPTION OF EMBODIMENTS OF THE INVENTION

Next, the reasons as to why elements constituting aspects of the present invention are limited are described.

First, the grain-oriented magnetic steel sheets according to aspects of interest in the present invention may be of any steel without limitation. A grain-oriented magnetic steel sheet is usually produced by hot rolling a silicon-containing steel slab by a known method, cold rolling the steel sheet one time or two or more times via intermediate annealing to a final sheet thickness, performing primary recrystallization annealing, applying an annealing separator, and finish annealing the steel sheet. The grain-oriented magnetic steel sheet after the finish annealing generally has a forsterite undercoating on the surface of the steel sheet. In some cases, alumina or a powdery mixture of magnesia and chloride is used as the annealing separator so that any undercoating will not be substantially formed on the surface, and thereby blanking properties and magnetic characteristics are enhanced. In other cases, the forsterite undercoating on the surface of the grain-oriented magnetic steel sheet is removed by chemical polishing or the like.

Aspects of the present invention are effective for forming a coating with excellent moisture absorption resistance and coating tension even on such a grain-oriented magnetic steel sheet having no undercoating.

The insulating tension coating with excellent water resistance and coating tension that is obtained according to aspects the present invention contains a phosphate salt and silica, and further includes a crystalline compound of the aforementioned general formula (1) which is present in the coating. The method for forming such a coating is not particularly limited. The scope of the present invention excludes compounds of the general formula (1) in which $M^{III}$ is Cr and $X^{V}$ is As because such compounds, although having a similar crystal structure, are substances of concern.

Whether a crystalline compound of the general formula (1) is present in the insulating tension coating can be easily determined by, for example, performing X-ray diffractometry shown in Table 1.

In accordance with aspects of the present invention, a crystalline compound represented by the general formula (1) can be incorporated into the insulating tension coating by, for example, a method in which an insulating tension coating liquid is applied to a surface of a finish annealed grain-oriented magnetic steel sheet, the coating liquid including 20 parts by mass in terms of solid of colloidal silica, 10 to 80 parts by mass of a phosphate salt and 5 to 10 parts by mass in terms of oxide of a metal element M-containing compound (the metal element M is one, or two or more selected from Sc, Ti, V, Mn, Fe, Co, Ni, Cu and Mg), and the steel sheet is heat treated at least one time at a temperature of not less than 900° C. in a non-oxidizing atmosphere while controlling the dew point to not more than 0° C. In this method, the form of the metal element M-containing compound is not particularly limited, but a water soluble compound or a hardly cohesive compound is preferable because such a compound can be effectively dispersed in a good state in the insulating tension coating liquid. For example, some preferred metal element M-containing compounds are iron (II) sulfate, iron (III) hydroxide, manganese (II) sulfate, copper (II) sulfate and magnesium nitrate. The phrase "in terms of oxide" means that the amount of the metal element M-containing compound is converted to that of $M^{II}O$ (when the compound is a Sc-containing compound, the amount thereof is converted to that of ScO; when the compound is a Ti-containing compound, the amount thereof is converted to that of TiO; when the compound is a V-containing compound, the amount thereof is converted to that of VO; when the compound is a Mn-containing compound, the amount thereof is converted to that of MnO; when the compound is an Fe-containing compound, the amount thereof is converted to that of FeO; when the compound is a Co-containing compound, the amount thereof is converted to that of CoO; when the compound is a Ni-containing compound, the amount thereof is converted to that of NiO; when the compound is a Cu-containing compound, the amount thereof is converted to that of CuO; or when the compound is a Mg-containing compound, the amount thereof is converted to that of MgO). The heat treatment performed for the first time in a non-oxidizing atmosphere often serves also as flattening annealing in the process of manufacturing grain-oriented magnetic steel sheets. Crystallization may not proceed at a temperature adopted for such flattening annealing. In such a case, further heat treatment may be performed at 900° C. or above to effect crystallization. The temperature required for the crystallization of $M^{II}{}_3M^{III}{}_4(X^{V}O_4)_6$ is variable depending on the type of crystal, and thus the temperature may be adjusted appropriately. In most cases, the crystallization can be induced by heat treatment at 900° C. or above, preferably 950° C. or above, and more preferably 1000° C. or above. The term "non-oxidizing atmosphere" means that the atmosphere includes, for example, an inert gas such as nitrogen or argon containing 1000 ppm or less oxygen (volume concentration), or the atmosphere is a reducing gas atmosphere including a reducing gas such as hydrogen or carbon monoxide. In the above method, the dew point of the non-oxidizing atmosphere needs to be controlled to not more than 0° C. Although the mechanism is not fully understood, it is probable that if the atmosphere is oxidative, the chemical reaction which forms the $M^{II}{}_3M^{III}{}_4(X^{V}O_4)_6$ structure is adversely affected and the formation of the $M^{II}{}_3M^{III}{}_4(X^{V}O_4)_6$ structure is inhibited. The dew point of the non-oxidizing atmosphere is preferably not more than −10° C. The lower limit of the dew point of the non-oxidizing atmosphere is not particularly limited, but the dew point of the non-oxidizing atmosphere is preferably not less than −40° C. Lowering the dew point temperature to below −40° C. does not deteriorate the quality of the coating, but only raises the atmosphere control costs. The dew point of the non-oxidizing atmosphere is more preferably not less than −30° C.

In accordance with aspects of the present invention, another method for incorporating a crystalline compound represented by the general formula (1) into the insulating tension coating is such that an insulating tension coating liquid is applied to a surface of a finish annealed grain-oriented magnetic steel sheet, the coating liquid including 20 parts by mass in terms of solid of colloidal silica, 10 to 80 parts by mass of a phosphate salt, and an amount of a crystalline compound represented by the general formula (1), and the steel sheet is heat treated at least one time in a non-oxidizing atmosphere to form a coating. Because this method involves the addition of $M^{II}_3M^{III}_4(X^VO_4)_6$ crystal, the heat treatment that is performed at least one time in a non-oxidizing atmosphere serves to bake the coating and thus may be performed under conventional conditions, for example, in a $N_2$ atmosphere at 700 to 900° C. for about 5 to 60 seconds. The crystalline compound of the general formula (1) used in this method is preferably one having an average particle size of not more than 1.0 μm, and more preferably one having an average particle size of not more than 0.5 μm. If the average particle size is more than 1.0 μm, the crystalline compound represented by the general formula (1) adversely affects the surface properties of the coating and tends to give rise to gaps between the steel sheets when used in a transformer, thus causing a decrease in space factor and a poor transformer performance. While the average particle size may be measured by any method without limitation, the average particle size measured herein is the particle size at 50% cumulative volume (D50) in a particle size distribution measured by a laser diffraction scattering method.

The silica in the insulating tension coating is a component that is necessary for imparting a tension to the steel sheet and reducing the iron loss. The phosphate salt serves as a binder for the silica to enhance coating formability and to effectively contribute to enhancing the coating adhesion.

In the insulating tension coating liquid, the amount of the phosphate salt is limited to not less than 10 parts by mass per 20 parts by mass in terms of solid of the colloidal silica. If the amount of the phosphate salt is less than 10 parts by mass, the coating incurs large cracks and exhibits insufficient moisture absorption resistance, which is an important characteristic of the top coating. The amount of the phosphate salt is limited to not more than 80 parts by mass per 20 parts by mass in terms of solid of the colloidal silica. If the amount of the phosphate salt is more than 80 parts by mass, the amount of the colloidal silica is relatively reduced and the tension is lowered with the result that the iron loss cannot be reduced effectively. The amount of the phosphate salt is more preferably in the range of 15 to 40 parts by mass per 20 parts by mass in terms of solid of the colloidal silica. The phosphate salt is preferably one, or two or more selected from phosphate salts of Mg, Fe, Al, Ca, Mn and Zn. In the insulating tension coating liquid, the amount of the crystalline compound of the general formula (1) is preferably 5 to 10 parts by mass per 20 parts by mass in terms of solid of the colloidal silica.

The insulating tension coating according to aspects of the present invention has an amount of P leaching of not more than 150 [μg/150 $cm^2$]. Preferably, the amount of P leaching of the insulating tension according to aspects coating of the present invention is less than 100 [μg/150 $cm^2$], more preferably not more than 90 [μg/150 $cm^2$], still more preferably not more than 80 [μg/150 $cm^2$], and particularly preferably not more than 70 [μg/150 $cm^2$]. The amount of P leaching is a value measured by the moisture absorption resistance test described hereinabove. The insulating tension coating according to aspects of the present invention preferably has a coating tension of not less than 5.5 MPa, more preferably not less than 6.0 MPa, still more preferably not less than 7.0 MPa, particularly preferably not less than 7.5 MPa, and most preferably not less than 8.0 MPa. The coating tension is a value measured by the coating tension test described hereinabove. The amount of P leaching and the coating tension may be controlled by controlling the ratio of the amounts of the phosphate salt, the silica and the crystalline compound of the general formula (1) in the insulating tension coating.

In the production of the grain-oriented magnetic steel sheets with insulating tension coating according to aspects of the present invention, a step may be added in which grooves are formed at regular intervals by etching the surface or applying a grooved roller, a laser beam or the like to the surface, or in which thermal strain is introduced by irradiating the steel sheet with a laser beam, plasma flame or the like after the formation of the insulating tension coating. Such magnetic domain refining treatment is effective for reducing the iron loss.

EXAMPLES

(Example 1) Inventive Examples Involving Crystallization Heat Treatment

Insulating tension coating liquids having a composition shown in Table 2 were each applied to the surface of a finish annealed grain-oriented magnetic steel sheet so that the total coating mass on both sides would be 10 g/$m^2$. The steel sheets were dried in a drying furnace at 250° C. for 120 seconds, and were heat treated beforehand at 800° C. for 2 minutes in a $N_2$ atmosphere having a dew point of −20° C.

Thereafter, the steel sheets were heat treated at 1000° C. for 15 seconds in a $N_2$ atmosphere having a dew point of −20° C. The oxygen concentration in the $N_2$ atmosphere was not more than 1000 ppm.

The grain-oriented magnetic steel sheets with insulating tension coating obtained as described above were tested by the following methods to evaluate the iron loss, the coating tension and the moisture absorption resistance.

The iron loss was measured in accordance with JIS C 2550 with respect to test pieces 30 mm in width×280 mm in length prepared by the grain-oriented magnetic steel sheet with insulating tension coating.

The coating tension σ was determined in the following manner using the equation described below. A test piece 30 mm in width×280 mm in length prepared by the grain-oriented magnetic steel sheet with insulating tension coating was cleaned of the insulating tension coating on one side with use of agents such as alkali and acid. A 30 mm end portion of the test piece was fixed, and the warpage over the measurement length (250 mm) of the test piece was measured. The Young's modulus of the steel sheet was 121520 MPa.

σ (MPa)=Young's modulus (MPa) of steel sheet× Sheet thickness (mm)×Warpage (mm)/(Measurement length (mm))$^2$ The moisture absorption resistance is a measure of the resistance of the insulating tension coating to dissolution in water. Three 50 mm×50 mm test pieces prepared by the grain-oriented magnetic steel sheet with insulating tension coating were soaked in boiling distilled water at 100° C. for 5 minutes to cause phosphorus to leach from the surface of the insulating tension coating. The solubility was evaluated based on the amount of leaching [μg/150 $cm^2$]. The moisture absorption resistance was evaluated as good when the amount of leaching was not more than 150 [μg/150 $cm^2$]. In accordance with aspects of the present invention, phosphorus which leached was quantitatively analyzed by ICP emission spectroscopy. However, the P leaching quantifying method is not limited thereto.

The evaluation results are described in Table 2.

TABLE 2

| No. | Amount of colloidal silica added [in terms of solid] (parts by mass) | Phosphate salt Type | Phosphate salt Added amount (parts by mass) | Compound containing metal element M Type | Compound containing metal element M Added amount [in terms of oxide] (parts by mass) | Iron loss W17/50 (W/kg) | Coating tension (MPa) | Amount of P leaching (μg/150 cm$^2$) | Product identified by X-ray diffractometry | Remarks |
|---|---|---|---|---|---|---|---|---|---|---|
| 1 | 20 | Al primary phosphate | 5 | Fe (II) sulfate | 5 | 0.779 | Coating separated and was not tested. | | | Comp. Ex. |
| 2 | 20 | Al primary phosphate | 40 | Fe (III) hydroxide | 5 | 0.742 | 9.1 | 21 | $Fe_7(PO_4)_6$ | Inv. Ex. |
| 3 | 20 | Al primary phosphate | 80 | Fe (III) hydroxide | 1 | 0.781 | 5.1 | 123 | None | Comp. Ex. |
| 4 | 20 | Mg primary phosphate | 40 | Ti (III) oxide | 5 | 0.746 | 8.4 | 57 | $Mg_3Ti_4(PO_4)_6$ | Inv. Ex. |
| 5 | 20 | Ca primary phosphate | 40 | Mn (II) sulfate | 10 | 0.751 | 8.3 | 51 | $Ca_3Mn_4(PO_4)_6$ | Inv. Ex. |
| 6 | 20 | Fe primary phosphate | 40 | Co (II) chloride | 5 | 0.746 | 8.9 | 39 | $Co_3Fe_4(PO_4)_6$ | Inv. Ex. |
| 7 | 20 | Fe primary phosphate | 40 | Ni (II) sulfate | 5 | 0.747 | 8.8 | 40 | $Ni_3Fe_4(PO_4)_6$ | Inv. Ex. |
| 8 | 20 | Fe primary phosphate | 40 | Cu (II) sulfate | 5 | 0.749 | 8.8 | 30 | $Cu_3Fe_4(PO_4)_6$ | Inv. Ex. |
| 9 | 20 | Fe primary phosphate | 40 | Mg (II) sulfate | 10 | 0.752 | 8.8 | 43 | $Mg_3Fe_4(PO_4)_6$ | Inv. Ex. |
| 10 | 20 | Mg primary phosphate | 5 | Fe (III) hydroxide | 5 | 0.782 | Coating separated and was not tested. | | | Comp. Ex. |
| 11 | 20 | Mg primary phosphate/ Fe primary phosphate | 40 (35/5) | Mg (II) hydroxide | 5 | 0.748 | 8.9 | 43 | $Mg_3Fe_4(PO_4)_6$ | Inv. Ex. |
| 12 | 20 | Mg primary phosphate | 80 | V (IV) sulfate | 10 | 0.753 | 8.4 | 49 | $Mg_3V_4(PO_4)_6$ | Inv. Ex. |
| 13 | 20 | Fe primary phosphate | 40 | Mn (II) nitrate | 5 | 0.746 | 8.8 | 38 | $Mn_3Fe_4(PO_4)_6$ | Inv. Ex. |
| 14 | 20 | Mg primary phosphate/ Al primary phosphate | 40 (20/20) | Fe (III) chloride | 10 | 0.740 | 9.0 | 28 | $Fe_7(PO_4)_6$ | Inv. Ex. |
| 15 | 20 | Mg primary phosphate/ Mn primary phosphate | 40 (35/5) | K manganate (Mn (III)) | 10 | 0.750 | 8.7 | 51 | $Mg_3Mn_4(PO_4)_6$ | Inv. Ex. |
| 16 | 20 | Mg primary phosphate/ Mn primary phosphate | 40 (35/5) | Fe (II) sulfate | 10 | 0.753 | 8.5 | 43 | $Mn_2Mg_1Fe_4(PO_4)_6$ | Inv. Ex. |
| 17 | 20 | Zn primary phosphate | 40 | Fe (III) nitrate | 5 | 0.741 | 9.2 | 24 | $Fe_7(PO_4)_6$ | Inv. Ex. |

(Note)
The underlines indicate that the amount is outside the range of the present invention.

As shown in Table 2, coatings having excellent coating tension and moisture absorption resistance were obtained when the insulating tension coating liquid contained, per 20 parts by mass in terms of solid of colloidal silica, 40 to 80 parts by mass of a phosphate salt and 5 to 10 parts by mass in terms of oxide of a metal element M-containing compound. Further, the amount of P leaching was markedly reduced, that is, the moisture absorption resistance of the insulating tension coating was particularly excellent when the product identified by X-ray diffractometry was $Fe_7(PO_4)_6$.

In contrast, sufficient coating tension was not obtained in Comparative Examples. The coating separated when the insulating tension coating liquid contained less than 10 parts by mass of a phosphate salt per 20 parts by mass in terms of solid of colloidal silica.

(Example 2) Inventive Examples Involving Addition of Crystalline Compound Represented by $M^{II}{}_3M^{III}{}_4(X^VO_4)_6$ Insulating tension coating liquids were prepared by adding 40 parts by mass of aluminum primary phosphate and 5 parts by mass of a crystalline compound $M^{II}{}_3M^{III}{}_4(X^VO_4)_6$ shown in Table 3, to 20 parts by mass in terms of solid of colloidal silica. The crystalline compounds shown in Table 3 were each prepared as described below, and were identified based on a diffraction peak obtained by X-ray diffractometry of the powder obtained. Further, the powder obtained was analyzed by a laser diffraction scattering method and was confirmed to have an average particle size of not more than 1.0 μm. The X-ray diffractometry was performed using a Cu target at 20 kV and 250 mA. With X-ray diffraction pattern analysis software JADE (manufactured by Rigaku Corporation), the background of the diffraction pattern was removed, and the diffraction peaks were analyzed to identify the crystal.

(i): Iron (III) oxide was dissolved into phosphoric acid, and ammonia was added to precipitate a powder (coprecipitation).

(ii), (iii) and (iv): A powder was precipitated by adding ammonia to a solution of magnesium (II) nitrate tetrahydrate, manganese (II) nitrate hexahydrate and iron (III) nitrate nonahydrate in phosphoric acid (coprecipitation).

(v): A powder was obtained by reacting a mixture of powders of copper (II) oxide, iron (III) oxide and vanadium pentoxide at 900° C. for 48 hours (solid-phase reaction).

(vi): A powder was obtained by reacting a mixture of powders of cobalt (II) oxide, iron (III) oxide and vanadium pentoxide at 800° C. for 20 hours (solid-phase reaction).

(vii): A powder was obtained by reacting a mixture of powders of manganese (III) oxide, iron (III) oxide and vanadium pentoxide at 700° C. for 20 hours (solid-phase reaction).

In the above production methods, the components were added in amounts corresponding to the stoichiometric ratio of the product (the crystalline compound). The crystalline powders obtained by coprecipitation were dried by being held in a drying furnace at 100° C. for 10 hours.

The insulating tension coating liquids were sufficiently stirred and were each applied to the surface of a finish annealed grain-oriented magnetic steel sheet so that the total coating mass on both sides would be 10 g/m$^2$. The steel sheets were dried in a drying furnace at 250° C. for 120 seconds, and were baked at 800° C. for 2 minutes in a $N_2$ atmosphere having a dew point of −20° C. The oxygen concentration in the $N_2$ atmosphere was not more than 1000 ppm. The grain-oriented magnetic steel sheets with insulating tension coating obtained as described above were tested in the same manner as EXAMPLE 1 to evaluate the iron loss, the coating tension and the moisture absorption resistance. The evaluation results are described in Table 3.

TABLE 3

| No. | Additive | Iron loss W17/50 (W/kg) | Coating tension (MPa) | Amount of P leaching (μg/150 cm²) | Remarks |
|---|---|---|---|---|---|
| (i) | $Fe_7(PO_4)_6$ | 0.742 | 9.6 | 31 | Inv. Ex. |
| (ii) | $Mn_{1.5}Mg_{1.5}Fe_4(PO_4)_6$ *Solid solution | 0.746 | 9.1 | 56 | Inv. Ex. |
| (iii) | $MnMg_2Fe_4(PO_4)_6$ *Solid solution | 0.749 | 9.0 | 41 | Inv. Ex. |
| (iv) | $Mg_3Fe_4(PO_4)_6$ | 0.744 | 8.9 | 44 | Inv. Ex. |
| (v) | $Cu_3Fe_4(VO_4)_6$ | 0.751 | 8.6 | 51 | Inv. Ex. |
| (vi) | $Co_3Fe_4(VO_4)_6$ | 0.759 | 7.9 | 52 | Inv. Ex. |
| (vii) | $Mn_3Fe_4(VO_4)_6$ | 0.757 | 8.4 | 48 | Inv. Ex. |

As shown in Table 3, coatings with excellent coating tension and moisture absorption resistance were obtained by the addition of the crystalline compounds.

The invention claimed is:

1. A grain-oriented magnetic steel sheet with chromium-free insulating tension coating, comprising a grain-oriented magnetic steel sheet and an insulating tension coating containing a phosphate salt and silica on at least one side of the grain-oriented magnetic steel sheet, the coating further including a crystalline compound represented by the general formula (1) below:

$$M^{II}{}_3M^{III}{}_4(X^VO_4)_6 \quad (1)$$

in the general formula (1), $M^{II}$ and $M^{III}$ are each independently one, or two or more selected from Sc, Ti, V, Mn, Fe, Co, Ni, Cu and Mg, and $X^V$ is one, or two or more selected from P, V and Mo.

2. The grain-oriented magnetic steel sheet with chromium-free insulating tension coating according to claim 1, wherein $M^{III}$ is Fe and $X^v$ is P in the general formula (1).

3. The grain-oriented magnetic steel sheet with chromium-free insulating tension coating according to claim 1, wherein the crystalline compound represented by the general formula (1) is $Fe_7(PO_4)_6$.

4. The grain-oriented magnetic steel sheet with chromium-free insulating tension coating according to claim 2, wherein the crystalline compound represented by the general formula (1) is $Fe_7(PO_4)_6$.

5. The grain-oriented magnetic steel sheet with chromium-free insulating tension coating according to claim 1, wherein the phosphate salt is one, or two or more selected from phosphate salts of Mg, Fe, Al, Ca, Mn and Zn.

6. The grain-oriented magnetic steel sheet with chromium-free insulating tension coating according to claim 2, wherein the phosphate salt is one, or two or more selected from phosphate salts of Mg, Fe, Al, Ca, Mn and Zn.

7. The grain-oriented magnetic steel sheet with chromium-free insulating tension coating according to claim 3, wherein the phosphate salt is one, or two or more selected from phosphate salts of Mg, Fe, Al, Ca, Mn and Zn.

8. The grain-oriented magnetic steel sheet with chromium-free insulating tension coating according to claim 4, wherein the phosphate salt is one, or two or more selected from phosphate salts of Mg, Fe, Al, Ca, Mn and Zn.

9. The grain-oriented magnetic steel sheet with chromium-free insulating tension coating according to claim 1, wherein in the general formula (1), at least one of $M^{II}$ and $M^{III}$ includes at least one selected from Sc, Ti, and V.

10. The grain-oriented magnetic steel sheet with chromium-free insulating tension coating according to claim 1, wherein crystalline compound represented by the general formula (1) Is formed by heat treating a coating comprising a metal M-containing compound selected from the group consisting of iron (II) sulfate, iron (III) hydroxide, manganese (II) sulfate, nickel (II) sulfate, copper (II) sulfate, magnesium (II) sulfate, magnesium (II) hydroxide, magnesium nitrate, manganese (II) nitrate, titanium (III) oxide, vanadium (IV) sulfate, potassium manganate (Mn (III)), and iron (III) nitrate.

11. The grain-oriented magnetic steel sheet with chromium-free insulating tension coating according to claim 1, wherein crystalline compound represented by the general formula (1) Is formed by heat treating a coating comprising a metal M-containing compound selected from the group consisting of iron (III) hydroxide, magnesium (II) hydroxide, magnesium nitrate, manganese (II) nitrate, titanium (III) oxide, vanadium (IV) sulfate, potassium manganate (Mn (III)), and iron (III) nitrate.

12. A method for producing a grain-oriented magnetic steel sheet with chromium-free insulating tension coating described in claim 1, comprising:

applying an insulating tension coating liquid to at least one side of a finish annealed grain-oriented magnetic steel sheet, the coating liquid comprising 20 parts by mass in terms of solid of colloidal silica, 10 to 80 parts by mass of a phosphate salt and 5 to 10 parts by mass in terms of oxide of a metal element M-containing compound (the metal element M is one, or two or more selected from Sc, TI, V, Mn, Fe, Co, Ni, Cu and Mg), and heat treating the steel sheet at least one time at a temperature of not less than 900° C. in an atmosphere Including a non-oxidizing gas and having a dew point of not more than 0° C.

13. A method for producing a grain-oriented magnetic steel sheet with chromium-free insulating tension coating described in claim 2, comprising:

applying an insulating tension coating liquid to at least one side of a finish annealed grain-oriented magnetic steel sheet, the coating liquid comprising 20 parts by mass in terms of solid of colloidal silica, 10 to 80 parts by mass of a phosphate salt and 5 to 10 parts by mass in terms of oxide of a metal element M-containing compound (the metal element M Is one, or two or more selected from Sc, Ti, V, Mn, Fe, Co, Ni, Cu and Mg), and heat treating the steel sheet at least one time at a temperature of not less than 900° C. in an atmosphere including a non-oxidizing gas and having a dew point of not more than 0° C.

14. A method for producing a grain-oriented magnetic steel sheet with chromium-free insulating tension coating described in claim 3, comprising:

applying an insulating tension coating liquid to at least one side of a finish annealed grain-oriented magnetic steel sheet, the coating liquid comprising 20 parts by mass in terms of solid of colloidal silica, 10 to 80 parts by mass of a phosphate salt and 5 to 10 parts by mass in terms of oxide of a metal element M-containing compound (the metal element M is one, or two or more selected from Sc, Ti, V, Mn, Fe, Co, Ni, Cu and Mg), and heat treating the steel sheet at least one time at a temperature of not less than 900° C. in an atmosphere including a non-oxidizing gas and having a dew point of not more than 0° C.

15. A method for producing a grain-oriented magnetic steel sheet with chromium-free insulating tension coating described in claim 4, comprising:

applying an insulating tension coating liquid to at least one side of a finish annealed grain-oriented magnetic steel sheet, the coating liquid comprising 20 parts by mass in terms of solid of colloidal silica, 10 to 80 parts by mass of a phosphate salt and 5 to 10 parts by mass in terms of oxide of a metal element M-containing compound (the metal element M is one, or two or more selected from Sc, Ti, V, Mn, Fe, Co, Ni, Cu and Mg), and heat treating the steel sheet at least one time at a temperature of not less than 900° C. in an atmosphere including a non-oxidizing gas and having a dew point of not more than 0° C.

16. A method for producing a grain-oriented magnetic steel sheet with chromium-free insulating tension coating described in claim 5, comprising:

applying an insulating tension coating liquid to at least one side of a finish annealed grain-oriented magnetic steel sheet, the coating liquid comprising 20 parts by mass in terms of solid of colloidal silica, 10 to 80 parts by mass of a phosphate salt and 5 to 10 parts by mass in terms of oxide of a metal element M-containing compound (the metal element M is one, or two or more selected from Sc, Ti, V, Mn, Fe, Co, Ni, Cu and Mg), and heat treating the steel sheet at least one time at a temperature of not less than 900° C. in an atmosphere including a non-oxidizing gas and having a dew point of not more than 0° C.

17. A method for producing a grain-oriented magnetic steel sheet with chromium-free insulating tension coating described in claim 6, comprising:

applying an insulating tension coating liquid to at least one side of a finish annealed grain-oriented magnetic steel sheet, the coating liquid comprising 20 parts by mass in terms of solid of colloidal silica, 10 to 80 parts by mass of a phosphate salt and 5 to 10 parts by mass in terms of oxide of a metal element M-containing compound (the metal element M is one, or two or more selected from Sc, Ti, V, Mn, Fe, Co, Ni, Cu and Mg), and heat treating the steel sheet at least one time at a temperature of not less than 900° C. in an atmosphere including a non-oxidizing gas and having a dew point of not more than 0° C.

18. A method for producing a grain-oriented magnetic steel sheet with chromium-free insulating tension coating described in claim 7, comprising:

applying an insulating tension coating liquid to at least one side of a finish annealed grain-oriented magnetic steel sheet, the coating liquid comprising 20 parts by mass in terms of solid of colloidal silica, 10 to 80 parts by mass of a phosphate salt and 5 to 10 parts by mass in terms of oxide of a metal element M-containing compound (the metal element M is one, or two or more selected from Sc, Ti, V, Mn, Fe, Co, Ni, Cu and Mg), and heat treating the steel sheet at least one time at a temperature of not less than 900° C. in an atmosphere including a non-oxidizing gas and having a dew point of not more than 0° C.

19. A method for producing a grain-oriented magnetic steel sheet with chromium-free insulating tension coating described in claim 8, comprising:

applying an Insulating tension coating liquid to at least one side of a finish annealed grain-oriented magnetic steel sheet, the coating liquid comprising 20 parts by mass in terms of solid of colloidal silica, 10 to 80 parts by mass of a phosphate salt and S to 10 parts by mass in terms of oxide of a metal element M-containing compound (the metal element M is one, or two or more selected from Sc, Ti, V, Mn, Fe, Co, Ni, Cu and Mg), and heat treating the steel sheet at least one time at a temperature of not less than 900° C. in an atmosphere including a non-oxidizing gas and having a dew point of not more than 0° C.

20. A method for producing a grain-oriented magnetic steel sheet with chromium-free insulating tension coating described in claim 1, comprising:

applying an insulating tension coating liquid to at least one side of a finish annealed grain-oriented magnetic steel sheet, the coating liquid comprising 20 parts by mass in terms of solid of colloidal silica, 10 to 80 parts by mass of a phosphate salt, and an amount of a crystalline compound represented by the general formula (1), and heat treating the steel sheet at least one time in a non-oxidizing atmosphere.

21. A method for producing a grain-oriented magnetic steel sheet with chromium-free insulating tension coating described in claim 2, comprising:

applying an insulating tension coating liquid to at least one side of a finish annealed grain-oriented magnetic steel sheet, the coating liquid comprising 20 parts by mass in terms of solid of colloidal silica, 10 to 80 parts by mass of a phosphate salt, and an amount of a crystalline compound represented by the general formula (1), and heat treating the steel sheet at least one time in a non-oxidizing atmosphere.

22. A method for producing a grain-oriented magnetic steel sheet with chromium-free Insulating tension coating described in claim 3, comprising:

applying an insulating tension coating liquid to at least one side of a finish annealed grain-oriented magnetic steel sheet, the coating liquid comprising 20 parts by mass in terms of solid of colloidal silica, 10 to 80 parts by mass of a phosphate salt, and an amount of a crystalline compound represented by the general formula (1), and heat treating the steel sheet at least one time in a non-oxidizing atmosphere.

23. A method for producing a grain-oriented magnetic steel sheet with chromium-free insulating tension coating described in claim 4, comprising:

applying an insulating tension coating liquid to at least one side of a finish annealed grain-oriented magnetic steel sheet, the coating liquid comprising 20 parts by mass in terms of solid of colloidal silica, 10 to 80 parts by mass of a phosphate salt, and an amount of a crystalline compound represented by the general formula (1), and heat treating the steel sheet at least one time in a non-oxidizing atmosphere.

* * * * *